US006839077B2

(12) United States Patent
Ikematsu

(10) Patent No.: US 6,839,077 B2
(45) Date of Patent: Jan. 4, 2005

(54) METHOD FOR CONTROLLING EXPOSURE AND SCAN-EXPOSURE APPARATUS

(75) Inventor: Teruji Ikematsu, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/917,880

(22) Filed: Jul. 31, 2001

(65) Prior Publication Data

US 2002/0018111 A1 Feb. 14, 2002

(30) Foreign Application Priority Data

Jul. 31, 2000 (JP) ..... 2000-232104

(51) Int. Cl.[7] ..... B41J 2/435
(52) U.S. Cl. ..... 347/248
(58) Field of Search ..... 347/225, 229, 347/234, 242, 245, 248, 257, 263; 359/692, 694, 698, 813, 819, 822, 823

(56) References Cited

U.S. PATENT DOCUMENTS 4,435,055 A * 3/1984 Berdat et al. ..... 396/105
6,025,867 A * 2/2000 Buus ..... 347/262
6,075,549 A * 6/2000 Bridges ..... 347/257
6,115,056 A * 9/2000 Eshed ..... 347/242
6,165,658 A * 12/2000 Taff et al. ..... 430/30
6,452,664 B2 * 9/2002 Miwa ..... 356/3.04
6,559,880 B2 * 5/2003 Ohba ..... 347/263
2001/0026312 A1 * 10/2001 Ohba ..... 347/263

* cited by examiner

*Primary Examiner*—Michael Nghiem
(74) *Attorney, Agent, or Firm*—Sughrue Mion, PLLC

(57) ABSTRACT

The present invention relates to a method for controlling exposure and a scan-exposure apparatus, which are used when a photosensitive material is scan-exposed. In the present invention, distance between a light source and a recording medium can be controlled on the basis of pre-measured distance correction data and timing at which light is emitted from the light source can be controlled on the basis of pre-measured light-emission correction data. Accordingly, it becomes possible to prevent the light beam irradiates the recording medium from going out of focus and to reduce the amount by which the position irradiated with the light beam deviates from a preset standard position.

19 Claims, 8 Drawing Sheets

METHOD FOR CONTROLLING EXPOSURE AND SCAN-EXPOSURE APPARATUS

BACKGROUND OF THE INVENTION

1. Field of the Invention

The present invention relates to a method for controlling exposure and a scan-exposure apparatus, which are used when a photosensitive material such as a printing plate is scan-exposed by a light beam emitted from a light source which moves along a main scanning direction or a sub-scanning direction.

2. Description of the Related Art

Some image exposure apparatuses, which expose photosensitive materials such as a photosensitive planographic printing plate (hereinafter, referred to as a "printing plate") used in printing or the like, include light sources such as a semiconductor laser or an LED, and scan-expose the printing plate by using a light beam emitted from the light source. Further, some image exposure apparatuses wind the printing plate onto a peripheral surface of a rotating drum and rotate the rotating drum in a predetermined direction to carry out main scanning for the printing plate, and move the light source, which is disposed opposite to the peripheral surface of the rotating drum, in an axial direction of the rotating drum to carry out sub-scanning for the printing plate.

In some scan-exposure apparatuses provided in such image exposure apparatuses, a light source is mounted on an exposure stage that is disposed opposite to the peripheral surface of the rotating drum and that is movable in a sub-scanning direction (i.e., the axial direction of the rotating drum). By moving the exposure stage in the sub-scanning direction, sub-scanning is carried out. In other words, in such a scan-exposure apparatus, an exposure head that is formed by mounting a light source on an exposure stage is moved in the sub-scanning direction.

In order to increase the accuracy with which an image is formed on a printing plate in an image exposure apparatus in which a printing plate is wound onto a rotating drum and an exposure head is moved in the axial direction of the rotating drum to scan and expose the printing plate, it is necessary to focus the light beam and adjust the position irradiated thereby when the rotating drum and the exposure head are assembled with the image exposure apparatus. Further, in order to carry out highly precise adjustments of this kind, it becomes necessary to machine with high precision the parts for the scan-exposure apparatus at the time those parts are manufactured.

For example, in order to adjust the distance between the rotating drum and the exposure head, the rotating drum must be mounted at an exact position on a surface plate and a guide for guiding the exposure head in the sub-scanning direction must be abutted and fixed at a positioning piece formed on the surface plate. Thereafter, the distance between an axis of the guide and an axis of the rotating drum must be accurately adjusted by using a predetermined jig. As a result, when the exposure head is moved along the guide, the distance between the exposure head and the rotating drum remains constant.

Further, in order to adjust the position on the rotating drum irradiated with the light beam, the surface of the surface plate on which the guide is mounted needs to be accurately machined, and, for example, a shim must be nipped between the guide and the surface plate when the guide is mounted on the surface plate.

It is necessary to machine the various parts of the scan-exposure apparatus with high precision at the time those parts are manufactured and assemble them with high precision in order to accurately adjust the positions as mentioned above, whereby the production cost of the scan-exposure apparatus increases.

SUMMARY OF THE INVENTION

In view of the above facts, an object of the present invention is to provide an exposure controlling method and a scan-exposure apparatus, which enable high-accuracy image exposure regardless of machining accuracy and assembling accuracy of parts.

A first aspect of the present invention is a method for controlling exposure, wherein a recording medium is irradiated with a light beam emitted from a light source which is moved along one of main scanning and sub-scanning directions by a light source scanning apparatus, the recording medium being moved along the other of the main scanning and the sub-scanning directions, to scan-expose the recording medium, the method comprising: distance correction processing, wherein, during scan-exposing of the recording medium, the light source is moved toward and away from the recording medium synchronously with the movement of the light source by the light source scanning apparatus, on the basis of distance correction data which is generated by measuring distance between the recording medium and the light source while the light source is being moved by the light source scanning apparatus.

While the light source is being moved in one of the main scanning direction and the sub-scanning direction by the light source scanning apparatus, the distance between the light source and the recording medium is measured, and on the basis of the measurement results, data for correcting the distance between the light source and the recording medium is generated as distance correction data.

When the light source is moved in the scanning direction and an image in accordance with image data is recorded on the recording medium, the light source is moved toward and away from the recording medium on the basis of the distance correction data, such that a predetermined distance is maintained between the light source and the recording medium, and the light beam emitted from the light source is constantly focussed onto the recording medium.

Accordingly, regardless of machining accuracy and assembling accuracy of parts, it is possible to prevent the light beam from going out of focus due to variations in the distance between the light source and the recording medium.

A second aspect of the present invention is a method for controlling exposure, wherein a recording medium is irradiated with a light beam emitted from a light source which is moved along one of main scanning and sub-scanning directions by a light source scanning apparatus, the recording medium being moved along the other of the main scanning and the sub-scanning directions, to scan-expose the recording medium, the method comprising: light-emission correction processing, wherein, during scan-exposing of the recording medium, light-emission of the light source is controlled synchronously with the movement of the light source by the light source scanning apparatus, on the basis of light-emission correction data which is generated by measuring a position irradiated by the light beam emitted from the light source onto the recording medium while the light source is being moved by the light source scanning apparatus.

While the light source is being moved in one of the main scanning direction and the sub-scanning direction by the light source scanning apparatus, the position irradiated with the light beam emitted from the light source is measured, and on the basis of the measurement results, data on deviations of the position irradiated with the light beam from a reference position on the recording medium is generated as the light-emission correction data for the light source.

When the light source is moved in the scanning direction and the image in accordance with the image data is recorded on the recording medium, for example, the image data is corrected on the basis of the light-emission correction data to irradiate the light beam at the reference position in accordance with the image data, such that deviations of the position irradiated with the light beam from the reference position along a direction in which the recording medium is moved do not affect the image recorded on the recording medium.

Accordingly, regardless of machining accuracy and assembling accuracy of parts, deviations of the position irradiated with the light beam from the reference position resulting from the scanning movement of the light source can be prevented from affecting the finished image which is formed on the recording medium.

A third aspect of the present invention is a scan-exposure apparatus, wherein a recording medium is irradiated with a light beam emitted from a light source which is moved along one of main scanning and sub-scanning directions, the recording medium being moved along the other of the main scanning and the sub-scanning directions, to scan-expose the recording medium, the apparatus comprising: a) a light source scanning apparatus, which moves the light source in one of the main scanning and the sub-scanning directions synchronously with the movement of the recording medium moving in the other of the main scanning and the sub-scanning directions; b) a light source moving apparatus, which moves the light source toward and away from the recording medium; c) a distance correction data memory, which stores distance correction data, which is generated by measuring distance between the recording medium and the light source while the light source is being moved by the light source scanning apparatus; and d) a movement controlling apparatus, which, during the scan-exposing of the recording medium, operates the light source moving apparatus on the basis of the distance correction data which has been stored in the distance correction data memory, synchronously with the movement of the light source by the light source scanning apparatus.

A fourth aspect of the present invention is a scan-exposure apparatus, wherein a recording medium is irradiated with a light beam emitted from a light source which is moved along one of main scanning and sub-scanning directions, the recording medium being moved along the other of the main scanning and the sub-scanning directions, to scan-expose the recording medium, the apparatus comprising: a) a light source scanning apparatus, which moves the light source in one of the main scanning and the sub-scanning directions synchronously with the movement of the recording medium in the other of the main scanning and the sub-scanning directions; b) a light-emission correction data memory, which stores light-emission correction data, which is generated by measuring a position irradiated with the light beam emitted from the light source onto the recording medium while the light source is being moved by the light source scanning apparatus; and c) a light-emission controlling apparatus, which, during the scan-exposing of the recording medium, controls light-emission of the light source on the basis of the light-emission correction data which has been stored in the light-emission correction data memory, synchronously with the movement of the light source by the light source scanning apparatus.

A fifth aspect of the present invention is a scan-exposure apparatus, wherein a recording medium is irradiated with a light beam emitted from a light source which is moved along one of main scanning and sub-scanning directions, the recording medium being moved along the other of the main scanning and the sub-scanning directions, to scan-expose the recording medium, the apparatus comprising: a) a light source scanning apparatus, which moves the light source in one of the main scanning and the sub-scanning directions synchronously with the movement of the recording medium in the other of the main scanning and the sub-scanning directions; b) a light source moving apparatus, which moves the light source toward and away from the recording medium; c) a distance correction data memory, which stores distance correction data, which is generated by measuring distance between the recording medium and the light source while the light source is being moved by the light source scanning apparatus; d) a light-emission correction data memory, which stores light-emission correction data, which is generated by measuring a position irradiated with the light beam emitted from the light source onto the recording medium while the light source is being moved by the light source scanning apparatus; e) a movement controlling apparatus, which, during the scan-exposing of the recording medium, operates the light source moving apparatus on the basis of the distance correction data synchronously with the movement of the light source by the light source scanning apparatus; and f) a light-emission controlling apparatus, which, during the scan-exposing of the recording medium, controls light-emission of the light source on the basis of the light-emission correction data synchronously with the movement of the light source by the light source scanning apparatus.

DESCRIPTION OF THE PREFERRED EMBODIMENTS

Figure 1:
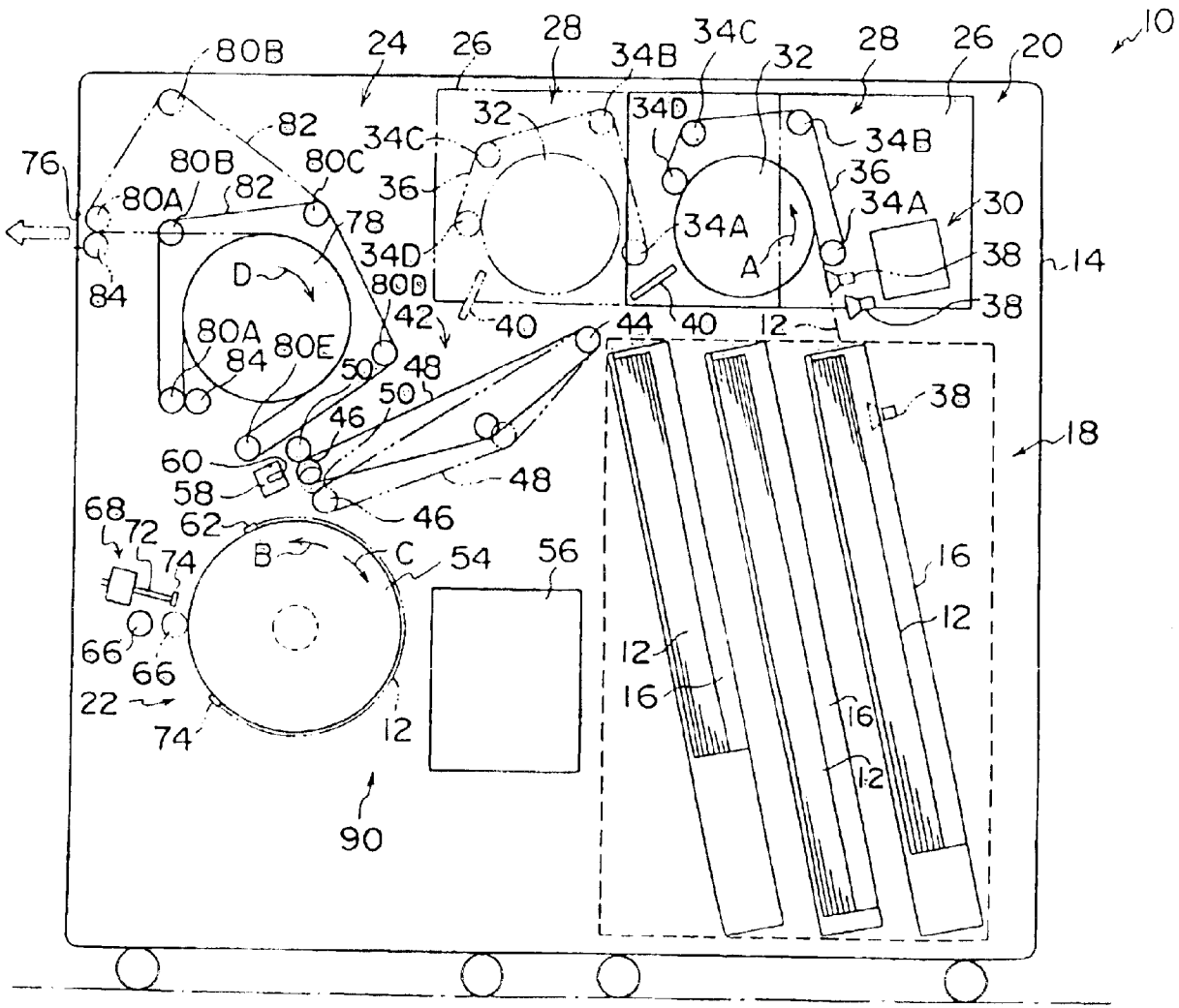
FIG. 1 is a schematic structural view of an image exposure apparatus to which the present invention is applied.

Hereinafter, a preferred embodiment of the present invention will be described with reference to drawings. FIG. 1 shows a schematic structure of an image exposure apparatus 10 to which the invention of the present embodiment has been applied. The image exposure apparatus 10 uses as recording medium a photosensitive planographic printing plate (hereinafter, referred to as a "printing plate 12") comprising a photosensitive layer formed on a thin (e.g., having a thickness of about 0.3 mm), rectangular plate-type support made of, for example, aluminum. The printing plate 12 is irradiated with a light beam modulated on the basis of image data, whereby the printing plate 12 is scan-exposed. The printing plate 12, for which image exposure has been completed by the image exposure apparatus 10, is then subjected to development processing and the like by an unillustrated automatic developing apparatus.

A cassette loading section 18, a plate supplying/conveying section 20, a recording section 22 and a discharge buffer section 24 are provided inside a casing 14. The cassette loading section 18 is disposed at a lower-right side in the casing 14 as shown in FIG. 1. In the cassette loading section 18, a plurality of cassettes 16, each accommodating a plurality of printing plates 12, is loaded in a state in which the cassettes 16 are inclined at a predetermined angle.

It is possible to process in the image exposure apparatus 10 numerous-sized printing plates 12 having different longitudinal and transverse dimensions. Printing plates 12 of whatever size are accommodated in the cassettes 16 such that the photosensitive layers of the printing plates 12 face upward and an end thereof is positioned to correspond to a predetermined position. Further, a plurality of the cassettes 16 is loaded in the cassette loading section 18 such that an end of the printing plates 12 accommodated in each cassette 16 reaches a substantially constant height at predetermined intervals.

The plate supplying/conveying section 20 is disposed above the cassette loading section 18, and the recording section 22 is disposed at a lower, central area within of the apparatus, adjacent to the cassette loading section 18. In the plate supplying/conveying section 20, an inverting unit 28 and a feed unit 30 are mounted onto a pair of side panels 26 (in FIG. 1, only one side panel 26 is shown).

The inverting unit 28 includes an inverting roller 32 having an external diameter of a predetermined dimension, and a plurality of small rollers 34 (in the present embodiment, four small rollers 34A, 34B, 34C and 34D are shown as an example) is provided around the inverting roller 32. The small rollers 34A through 34D are disposed so as to straddle the reverse roller 32 from the cassette loading section 18 to the recording section 22, and an endless conveyor belt 36 is entrained between the small rollers 34A to 34D. Accordingly, the conveyor belt 36 is wound on the reverse roller 32 so that the conveyor belt 36 is wound on roughly half the circumference of the reverse roller 32 between the small roller 34A and the small roller 34D.

The feed unit 30 includes a plurality of suction cups 38 that suck the top end of the printing plate 12 inside the cassette 16. The suction cups 38 are lowered to oppose the top end of the printing plate 12 inside the cassette 16 loaded in the cassette loading section 18, whereby the printing plate 12 is sucked by the suction cups 38. The feed unit 30 then raises the suction cups 38 which have sucked the printing plate 12 whereby the printing plate 12 is pulled out from the cassette 16 and a leading edge of the pulled out printing plate 12 is inserted between the inverting roller 32 and the conveyor belt 36. In FIG. 1, movement positions of the suction cups 38 are schematically shown with two-dot chain lines.

At the inverting unit 28, the inverting roller 32 and the conveyor belt 36 rotate in the direction that the printing plate 12 is pulled out from the cassette 16 (direction of arrow A in FIG. 1). When the leading edge of the printing plate 12 is inserted between the inverting roller 32 and the conveyor belt 36, the inverting unit 28 nips the inserted printing plate 12 therebetween, and conveys the printing plate 12 so as to pull it out from the cassette 16 and wind it onto the inverting roller 32. Therefore, the printing plate 12 is curved and conveyed such that the direction in which the printing plate 12 is conveyed is inverted. The radius of the reverse roller 32 is of a dimension (e.g., 100 mm) such that kinks or bends are not generated in the printing plate 12 when the printing plate 12 is curved.

As shown with solid lines and two-dot chain lines in FIG. 1, the side panels 26 horizontally move in accordance with the position of the cassette 16 from which the printing plate 12 is pulled out. Thus, the feed unit 30 can horizontally move together with the inverting unit 28 so that the suction cups 38 oppose the printing plate 12 within the cassette 16 that has been selected.

Further, on the side panels 26, a guide 40 is provided below the small roller 34D. The printing plate 12 which has been inverted by the inverting roller 32 is sent out from between the inverting roller 32 and the conveyor belt 36 toward the guide 40 at the small roller 34D side.

A conveyor 42 is disposed above the recording section 22, and the printing plate 12 which has been sent out from the inverting unit 28 is guided to the conveyor 42 by the guide 40. When the side panels 26 move, the guide 40 swings so as to always orient the direction in which the printing plate 12 is guided to the conveyor 42. When the side panels 26 move, the small roller 34D at the recording section 22 side moves so as to change the direction in which the printing plate 12 is sent out from the inverting unit 28, and when the small roller 34D moves, the small roller 34C moves so as to apply substantially constant tension to the conveyor belt 36. As a result, the printing plate 12 sent out from the inverting unit 28 is gently curved by the guide 40.

In the conveyor 42, a conveyor belt 48 is entrained between a roller 44 adjacent to an area below the guide 40 and a roller 46 adjacent to an area above the recording section 22. The conveyor 42 is inclined so that the roller 46 is disposed lower than the roller 44.

Figure 2:
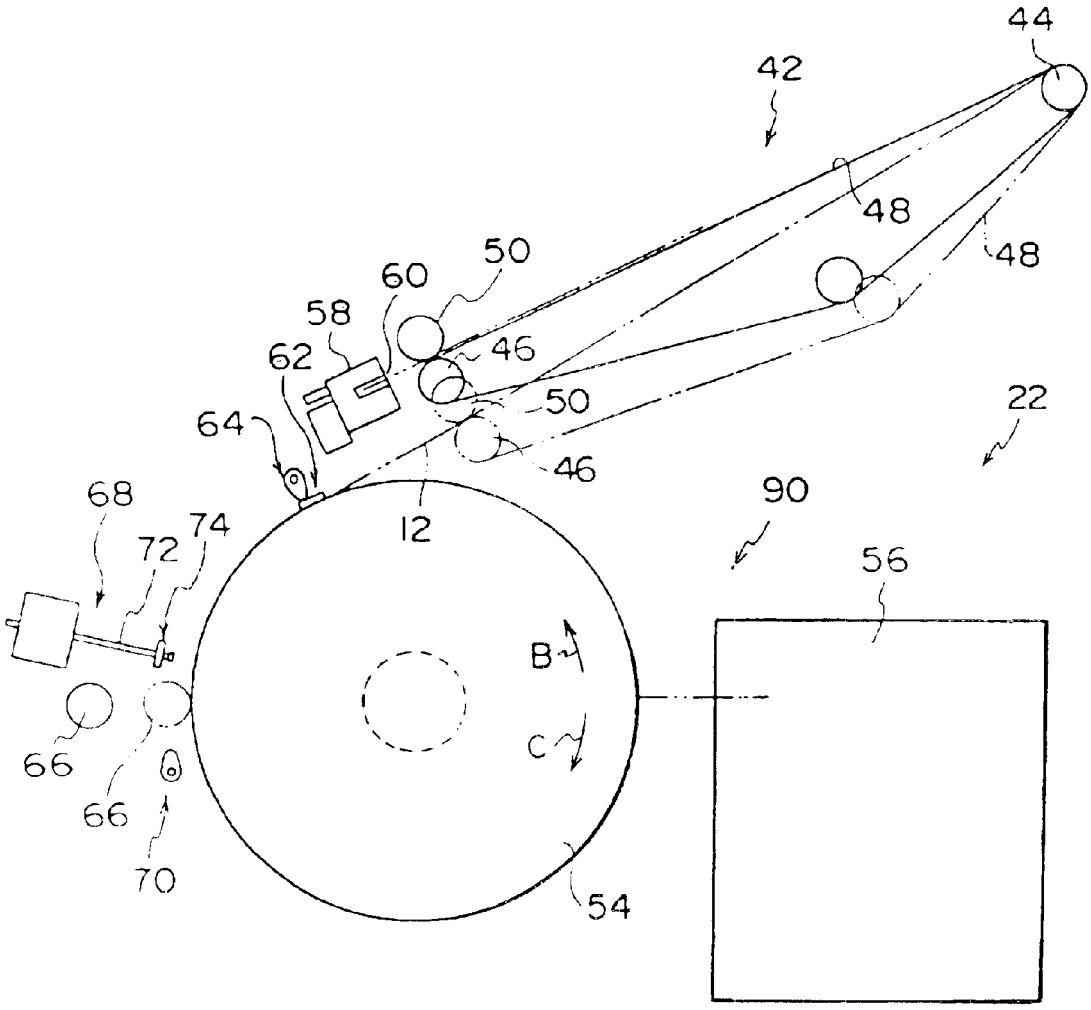
FIG. 2 is a schematic structural view of a recording section provided in the image exposure apparatus.

As shown in FIGS. 1 and 2, in the conveyor 42, a roller 50 is disposed opposite to the roller 46. The printing plate 12 which has been sent onto the conveyor 42 is conveyed on the conveyor belt 48, nipped between the rollers 46 and 50, and sent out from the conveyor 42.

In the recording section 22, a scan-exposure apparatus 90 is structured by a rotating drum 54 and a recording head portion 56 which is disposed opposite to the rotating drum 54. Further, above the rotating drum 54, a puncher 58 is provided opposite to the rollers 46 and 50 of the conveyor 42. The scan-exposure apparatus 90 will be described later in detail.

As shown in FIG. 2, a gripper 60 is formed at the puncher 58. The conveyor 42 nips the printing plate 12 between the rollers 46 and 50, and inserts the leading edge of the printing plate 12 into the gripper 60 of the puncher 58 so as to hold it. The puncher 58 punches, for example, a notch for positioning, at a predetermined position in the leading edge of the printing plate 12 which has been inserted into the gripper 60. For example, the printing plate 12 is positioned on the conveyor 42 and sent to the puncher 58, such that the notch for positioning is punched at the predetermined position of the leading edge thereof.

The conveyor 42 can be swung on an axis of the roller 44 by an unillustrated swinging apparatus (this movement is shown with solid lines and two-dot chain lines in FIGS. 1 and 2). When the notch has been punched at the printing plate 12, the conveyor 42 reversely drives the conveyor belt 48 so as to pull out the leading edge of the printing plate 12 from the gripper 60 of the puncher 58, and then, the conveyor 42 is swung to orient the leading edge of the printing plate 12 to a predetermined position on an external peripheral surface of the rotating drum 54. In this state, the printing plate 12 is sent out toward the recording section 22.

The rotating drum 54 provided in the recording section 22 is rotatingly driven by a driving force of an unillustrated driving mechanism at a predetermined rotational speed in the direction in which the printing plate 12 is attached to the rotating drum 54 and exposed thereon (i.e., the direction of arrow B in FIGS. 1 and 2) and in the direction in which the printing plate 12 is detached from the rotating drum 54 (i.e., the direction of arrow C in FIGS. 1 and 2, which direction is opposite that of the direction in which the printing plate 12 is attached to the rotating drum 54 and exposed thereon). It should be noted that the direction in which the printing plate 12 is attached to the rotating drum 54 and exposed thereon is the main scanning direction when the printing plate 12 is exposed.

As shown in FIG. 2, a leading edge chuck 62 is attached at a predetermined position on the external peripheral surface of the rotating drum 54. In the recording section 22, when the printing plate 12 is attached to the rotating drum 54, the rotating drum 54 is initially stopped at a position where the leading edge chuck 62 opposes the leading edge of the printing plate 12 sent by the conveyor 42 (i.e., the position at which the printing plate 12 is attached to the rotating drum 54).

The recording section 22 is provided with an attachment cam 64 opposite to the leading edge chuck 62 at the position at which the printing plate 12 is attached to the rotating drum 54, and the leading edge chuck 62 is pressed by rotation of the attachment cam 64. This enables the leading edge of the printing plate 12 to be inserted between the leading edge chuck 62 and the peripheral surface of the rotating drum 54. When the leading edge chuck 62 is released from being pressed by the attachment cam 64, the leading edge of the printing plate 12 which has been inserted between the leading edge chuck 62 and the rotating drum 54 is nipped so as to be fixed onto the rotating drum 54.

In the recording section 22, the leading edge of the printing plate 12 is fixed at a predetermined position on the peripheral surface of the rotating drum 54 by the leading edge chuck 62. When the rotating drum 54 is rotated in the direction in which the printing plate 12 is attached to the rotating drum 54 and exposed thereon, in a state in which the leading edge of the printing plate 12 is fixed, the printing plate 12 is wound onto the rotating drum 54. Further, on the rotating drum 54, pin protrudes at a predetermined position near the leading edge chuck 62, and the pin is inserted into the notch at the leading edge of the printing plate 12 to position the printing plate 12 on the rotating drum 54.

In the recording section 22, a squeeze roller 66 is disposed near the peripheral surface of the rotating drum 54 and further downstream, in the direction in which the printing plate 12 is attached to the rotating drum 54 and exposed thereon, than the position at which the printing plate 12 attaches to the rotating drum 54. The squeeze roller 66 moves toward the rotating drum 54, and presses the printing plate 12 wound onto the rotating drum 54 toward the rotating drum 54 so as to bring the printing plate 12 into close contact with the peripheral surface of the rotating drum 54.

Further, in the recording section 22, a trailing edge chuck attachment/detachment unit 68 is disposed further upstream than the squeeze roller 66 in the direction in which the printing plate 12 is attached to the rotating drum 54 and exposed thereon. A detachment cam 70 is disposed further downstream than the squeeze roller 66 in the direction in which the printing plate 12 is attached to the rotating drum 54 and exposed thereon. In the trailing edge chuck attachment/detachment unit 68, a trailing edge chuck 74 is detachably provided at a distal end of a shaft 72 that protrudes toward the rotating drum 54.

In the recording section 22, when the trailing edge of the printing plate 12 that is wound around the rotating drum 54 has reached a predetermined position at which the trailing edge chuck 74 attaches to and detaches from the rotating drum 54, which position is opposite to the trailing edge chuck attachment/detachment unit 68, the rotation of the rotating drum 54 is temporarily stopped and the trailing edge chuck 74 is attached at the predetermined position on the rotating drum 54. As a result, the trailing edge of the printing plate 12 which has been wound onto the rotating drum 54 is nipped between the trailing edge chuck 74 and the rotating drum 54 so as to be fixed onto the rotating drum 54.

An unillustrated suction groove, which sucks and holds the printing plate 12 wound onto the rotating drum 54, is formed on the external peripheral surface of the rotating drum 54. The suction groove sucks the printing plate 12 fixed by the leading edge chuck 62 and the trailing edge chuck 74 so as to bring the printing plate 12 into close contact with the peripheral surface of the rotating drum 54.

In the recording section 22, when the printing plate 12 has been wound onto the rotating drum 54, the squeeze roller 66 is separated therefrom. Then, while the rotating drum 54 is rapidly rotated at a predetermined rotational speed, the printing plate 12 is irradiated with a light beam modulated on the basis of image data emitted from the recording head portion 56 synchronously with the rotation of the rotating drum 54. In this way, the printing plate 12 which has been wound onto the rotating drum 54 is scan-exposed on the basis of the image data, and an image is formed at a predetermined position on the printing plate 12.

In the recording section 22, when scan-exposure of the printing plate 12 has been completed, the rotating drum 54 is stopped so that the trailing edge chuck 74 stops at the position at which the trailing edge chuck 74 is attached to and detached from the rotating drum 54 at the trailing edge chuck attachment/detachment position, and the printing plate 12 is nipped between the squeeze roller 66 and the rotating drum 54. In a state in which the printing plate 12 is nipped therebetween, the trailing edge chuck 74 is detached from the rotating drum 54 so as to release the trailing edge of the printing plate 12, and then, the rotating drum 54 is rotated in the direction in which the printing plate 12 detaches therefrom. Accordingly, the printing plate 12 is sent out from between the squeeze roller 66 and the rotating drum 54.

When the rotating drum 54 is rotated in the direction in which the printing plate 12 detaches therefrom, if the leading edge chuck 62 has reached the position at which the printing plate 12 detaches from the rotating drum 54, which position is opposite to the detachment cam 70, the rotating drum 54 is stopped. Then, the detachment cam 70 is rotated so as to press the leading edge chuck 62, and the leading edge of the printing plate 12 is released from being nipped and fixed. As a result, the printing plate 12 detaches from the rotating drum 54.

As shown in FIG. 1, the discharge buffer section 24 is provided substantially above the recording section 22. When the rotating drum 54 is rotated in the direction in which the printing plate 12 detaches therefrom, the trailing edge of the printing plate 12 is sent out toward the discharge buffer section 24.

The discharge buffer section 24 includes a discharge roller 78, which is provided adjacent to a discharge port 76 formed at the casing 14. A plurality of small rollers (five small rollers 80A, 80B, 80C, 80D and 80E are shown as an example) are disposed around the discharge roller 78, and an endless conveyor belt 82 is entrained between the small rollers 80A to 80E. The conveyor belt 82 is thus entrained between the small rollers 80A through 80E around the discharge roller 78 in a range of between about ½ to about ¾ the circumference of the discharge roller 78.

The small roller 80A protrudes toward the squeeze roller 66 side of the recording section 22, and a roller 84 is disposed opposite to the small roller 80A. The printing plate 12 sent out from the recording section 22 is nipped between the small roller 80A and the roller 84.

In the discharge buffer section 24, when the discharge roller 78 is rotatingly driven in a direction in which the printing plate 12 is pulled in (direction of arrow D), the printing plate 12 which has been nipped between the small roller 80A and the roller 84 is pulled out from the recording section 22 and guided to between the discharge roller 78 and the conveyor belt 82. Then, the printing plate 12 is nipped between the discharge roller 78 and the conveyor belt 82, and wound onto the discharge roller 78. At this time, in the discharge buffer section 24, the discharge roller 78 is stopped in a state in which an end portion of the printing plate 12 (trailing edge side thereof in the direction in which it is sent out from the recording section 22) is nipped between the small roller 80A and the roller 84, and the printing plate 12 which has been wound onto the discharge roller 78 is temporarily held.

As shown with two-dot chain lines in FIG. 1, in the discharge buffer section 24, the small roller 80A and the roller 84 move to a position which is opposite to the discharge port 76. At this time, the small roller 80A and the roller 84 integrally move such that the leading edge of the printing plate 12 is oriented toward the discharge port 76. When the small roller 80A moves, the small roller 80B which is above the small roller 80A moves so as to apply constant tension to the conveyor belt 82.

In the discharge buffer section 24, when the leading edge of the printing plate 12 has been oriented to the discharge port 76, the discharge roller 78 is rotatingly driven in the direction in which the printing plate 12 is sent out (direction which is opposite to arrow D) at a rotational speed in accordance with the speed at which of the printing plate 12 is conveyed by processing apparatuses, such as an automatic development apparatus, disposed adjacent to the discharge port 76. Accordingly, the printing plate 12 is sent out from the discharge port 76.

In the image exposure apparatus 10 structured in the above-described manner, the image data to be exposed onto the printing plate 12 is input, and the size, the number and the like of the printing plate 12 to be subjected to the image exposure are set. When the image exposure is instructed to initiate, image exposure processing of the printing plate 12 initiates. The order to initiate image exposure processing may be given by operating a switch at an operation panel provided at the image exposure apparatus 10, or may be given by signals from an image processing apparatus or the like which outputs image data to the image exposure apparatus 10.

In the image exposure apparatus 10, when the image exposure processing is initiated, the printing plate 12 having a specified size is pulled out from the cassette 16, loaded on the conveyor 42, and supplied to the recording section 22. At this time, the notch for positioning is punched into the printing plate 12 by the puncher 58.

In the recording section 22, the leading edge of the supplied printing plate 12 is held onto the rotating drum 54 by the leading edge chuck 62, the printing plate 12 is wound onto the rotating drum 54 while being squeezed by the squeeze roller 66, and the trailing edge of the printing plate 12 is held onto the rotating drum 54 by the trailing edge chuck 74.

Thereafter, in the recording section 22, while the rotating drum 54 is rapidly rotated, the printing plate 12 is irradiated with a light beam on the basis of image data emitted from the recording head portion 56 to scan-expose the printing plate 12. As a result, an image is formed in a predetermined region of the printing plate 12.

The printing plate 12 on which the image has been formed is sent out from the recording section 22 to the discharge buffer section 24. In the discharge buffer section 24, the printing plate 12 is nipped between the conveyor belt 82 and the discharge roller 78, and wound onto the discharge roller 78, and then the leading edge of the printing plate 12 is oriented to the discharge port 76 and the discharge roller 78 is reversely driven. As a result, the printing plate 12 is sent out from the discharge port 76 at a predetermined conveyance speed to be discharged from the image exposure apparatus 10.

At the scan-exposure apparatus 90 comprising the rotating drum 54 and the recording head portion 56 in the recording section 22, as described above, while the rotating drum 54 on which the printing plate 12 has been wound is rotatingly driven at a predetermined rotational speed in the main scanning direction (which is the direction in which the printing plate 12 is attached to the rotating drum 54 and exposed thereon) to carry out the main scanning, the printing plate 12 is irradiated with a light beam emitted from the recording head portion 56 along a sub-scanning direction to carry out sub-scanning. In this way, the printing plate 12 is scan-exposed. Rotation of the rotating drum 54 in the main scanning direction may be effected by a conventional, well-known mechanism, and detailed description of the mechanism will be omitted from this embodiment.

Figure 3:
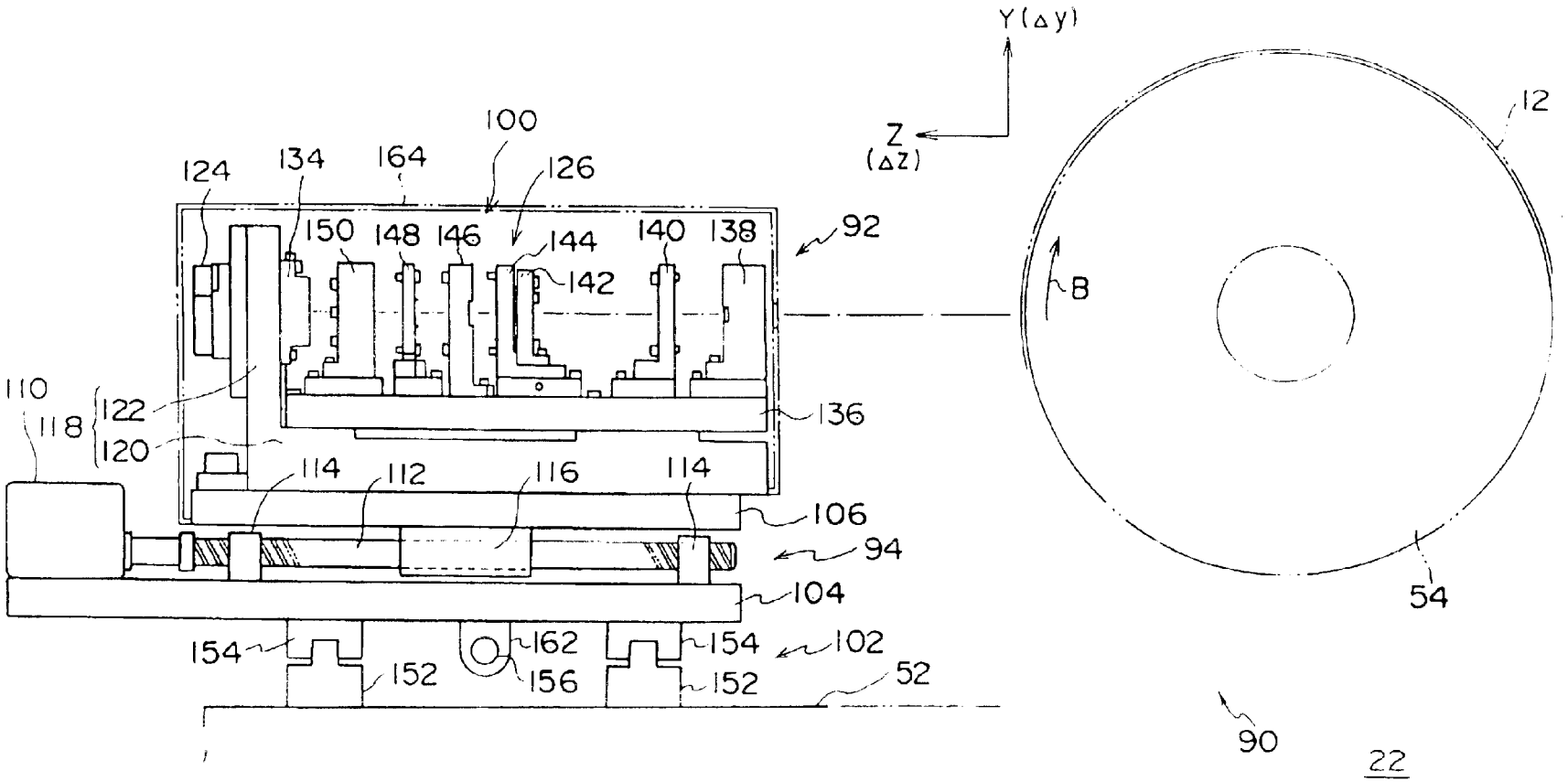
FIG. 3 is a schematic structural view of a scan-exposure apparatus provided at the recording section, when seen from one end side of a sub-scanning direction.

As shown in FIG. 3, an exposure head 92 which emits a light beam toward the printing plate 12 wound onto the rotating drum 54, and a sub-scanning mechanism 102 which moves the exposure head 92 in the sub-scanning direction (i.e., the direction orthogonal to the surface of the page on which FIG. 3 appears) are provided at the recording head portion 56.

At the exposure head 92, a light source unit 100 is mounted on a substantially rectangular plate-like stage 106. The light source unit 100 includes a substantially L-shaped base 118, which is formed by a base portion 120 having a substantially tie-plate shape and an upright wall portion 122 uprightly provided at one end of the base portion 120 in a longitudinal direction thereof. Further, the base 118 is fixed at a predetermined position on the stage 106 so that the other end of the base portion 120 in the longitudinal direction is disposed closer to the rotating drum 54 side.

At the light source unit 100, a light source assembly 124 and a parallel flat plate holder 134 are attached onto the upright wall portion 122, and an optical system assembly 126 is attached onto the base portion 120. The light source assembly 124 includes therein a laser diode, which is one of semiconductor light emitting elements, as a light emitting element forming a light source, and a collimator lens (illustration of laser diode and collimator lens are omitted in FIG. 3). Further, in the light source assembly 124, distance between the laser diode and the collimator lens is pre-adjusted. Therefore, when the light source assembly 124 is mounted on the upright wall portion 122, the laser diode and the collimator lens are attached at respective predetermined positions in the light source unit 100.

A parallel flat plate (not shown) is mounted on the parallel flat plate holder 134. At the light source unit 100, the parallel flat plate holder 134 is attached onto a surface at the optical system assembly 126 side of the upright wall portion 122 so as to oppose the light source assembly 124. A light beam emitted from the light source assembly 124 is transmitted through the parallel flat plate in the parallel flat plate holder 134 to the optical system assembly 126 on the base portion 120.

The optical system assembly 126 includes an elongated fixing table 136. On the fixing table 136, a condenser lens holder 138 to which a condenser lens is mounted, a cylindrical lens holder 140 to which a convex cylindrical lens is mounted, an uniaxial crystal holder 142 to which an uniaxial crystal is mounted, a cylindrical lens holder 144 to which a concave cylindrical lens is mounted, a parallel flat plate holder 146 to which a parallel flat plate is mounted, an aperture holder 148 to which an aperture is mounted, and a cylindrical lens holder 150 to which a convex cylindrical lens and a half-wave plate are mounted, are sequentially disposed.

Accordingly, the light beam emitted from the light source assembly 124 is transmitted through the parallel flat plate, the half-wave plate, the cylindrical lens, the aperture, the parallel flat plate, the cylindrical lens, the uniaxial crystal, the cylindrical lens and the condenser lens to irradiate the printing plate 12 wound on the peripheral surface of the rotating drum 54. The exposure stage 106 is disposed at a position where the distance between the exposure stage 106 and the rotating drum 54 is equal to a predetermined distance. Further, the light source assembly 124 and the optical system assembly 126 are attached onto the base 118, so that the light beam which is emitted from the light source unit 100 mounted on the exposure stage 106 to the printing plate 12 wound onto the rotating drum 54 has a predetermined spot diameter.

Figure 4:
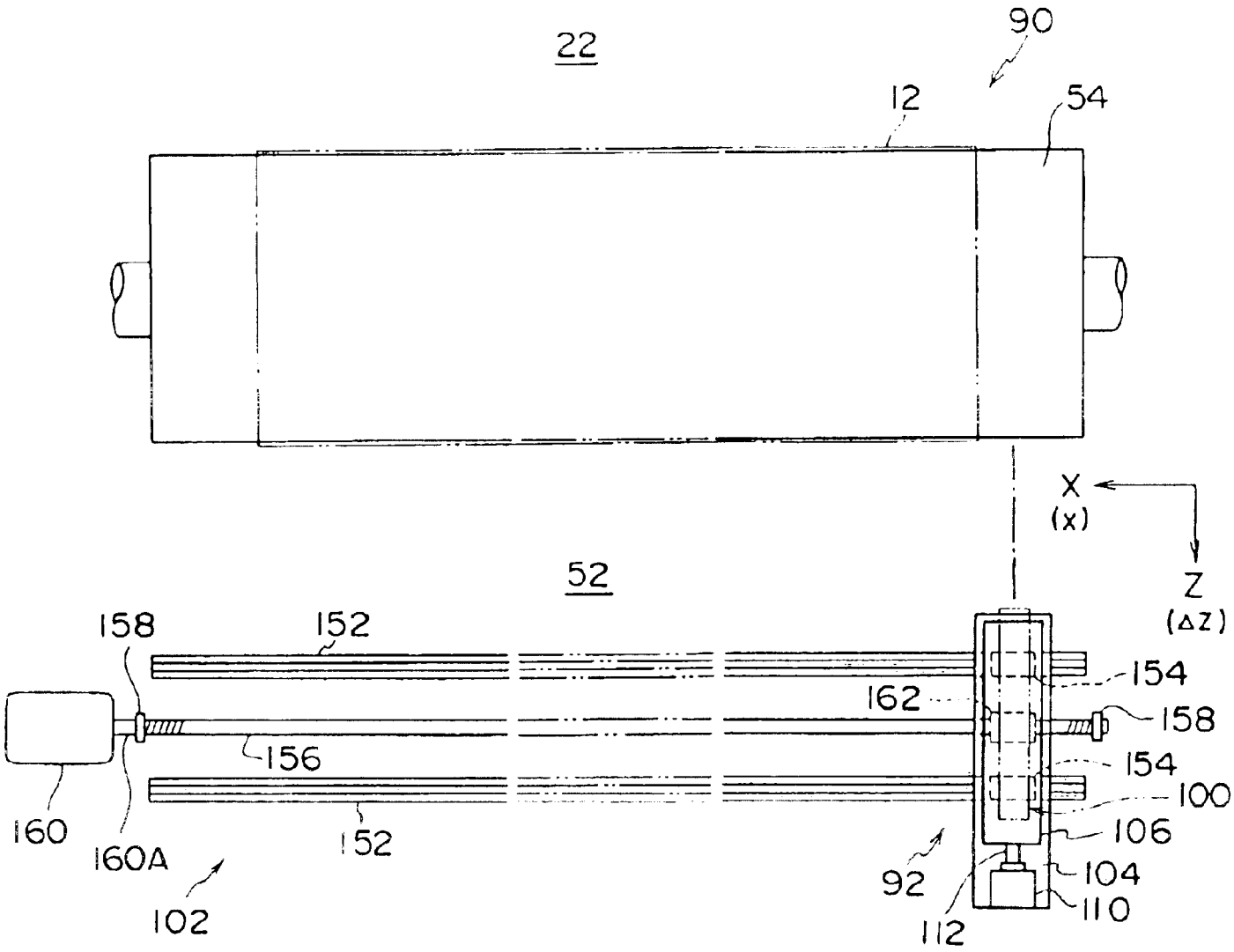
FIG. 4 is a schematic view showing positions of an exposure head and a rotating drum of the present invention.

As shown in FIGS. 3 and 4, the sub-scanning mechanism 102 is provided with a pair of guide rails 152, which are disposed so that longitudinal directions thereof are along an axial direction of the rotating drum 54. As shown in FIG. 3, the guide rails 152 are mounted at predetermined positions on an exposure surface plate 52. Further, the rotating drum 54 is rotatably supported to the exposure surface plate 52 via unillustrated side panels. At the scan-exposure apparatus 90, the rotational direction of the rotating drum 54 (direction of arrow B) is the main scanning direction, and the axial direction of the rotating drum 54 (direction of arrow X) is the sub-scanning direction.

As shown in FIGS. 3 and 4, a base plate 104 is disposed on the pair of guide rails 152. Sliders 154 are attached onto the base plate 104 to respectively oppose the guide rails 152, and the sliders 154 slidably engage with the guide rails 152. Therefore, the base plate 104 is supported so that it can move in the sub-scanning direction (direction of arrow X in FIG. 4) along the guide rails 152.

A feed screw 156 is disposed between the pair of guide rails 152. As shown in FIG. 4, the feed screw 156 is rotatably supported by brackets 158 attached onto the exposure surface plate 52, and a driving shaft 160A of a sub-scanning motor 160 is connected to one end of the feed screw 156 (illustration of these is omitted from FIG. 3). Further, a feed nut 162 is attached onto the base plate 104 between the sliders 154, and the feed screw 156 screws into the feed nut 162.

Accordingly, when the sub-scanning motor 160 is driven and rotates the feed screw 156, the base plate 104 moves in the sub-scanning direction along the guide rails 152.

As shown in FIG. 3, the base plate 104 is provided with a distance adjusting mechanism 94, and the exposure stage 106 (the exposure head 92) is mounted to the base plate 104 via the distance adjusting mechanism 94.

At the distance adjusting mechanism 94, a stepping motor 110 is attached to an end of the base plate 104 that is most distant from the rotating drum 54. A feed screw 112 is connected to the stepping motor 110. The feed screw 112 is disposed so that an axial direction thereof is along a direction of arrow Z, which is a direction toward and away from the rotating drum 54. Further, both end portions of the feed screw 112 are inserted into and rotatably supported by brackets 114, which are attached onto the base plate 104.

A feed nut 116 is attached onto a surface of the exposure stage 106 that is opposite to the surface on which the light source unit 100 is mounted (i.e., a lower surface of the exposure stage 106 in FIG. 3), and the feed screw 112 screws into the feed nut 116.

Accordingly, when the stepping motor 110 is driven to rotate the feed screw 112, the exposure head 92 mounted on the exposure stage 106 moves toward and away from the rotating drum 54. In other words, the stepping motor 110 is driven such that the distance between the exposure head 92 and the rotating drum 54 can be changed. Further, although illustration thereof is omitted, a pair of guide rails are mounted on the base plate 104 so that the feed screw 112 is disposed between the guide rails. Sliders which slidably engage with the guide rails are attached onto the exposure stage 106, and the exposure stage 106 is thereby supported so that it can move toward and away from the rotating drum 54.

Figure 5:
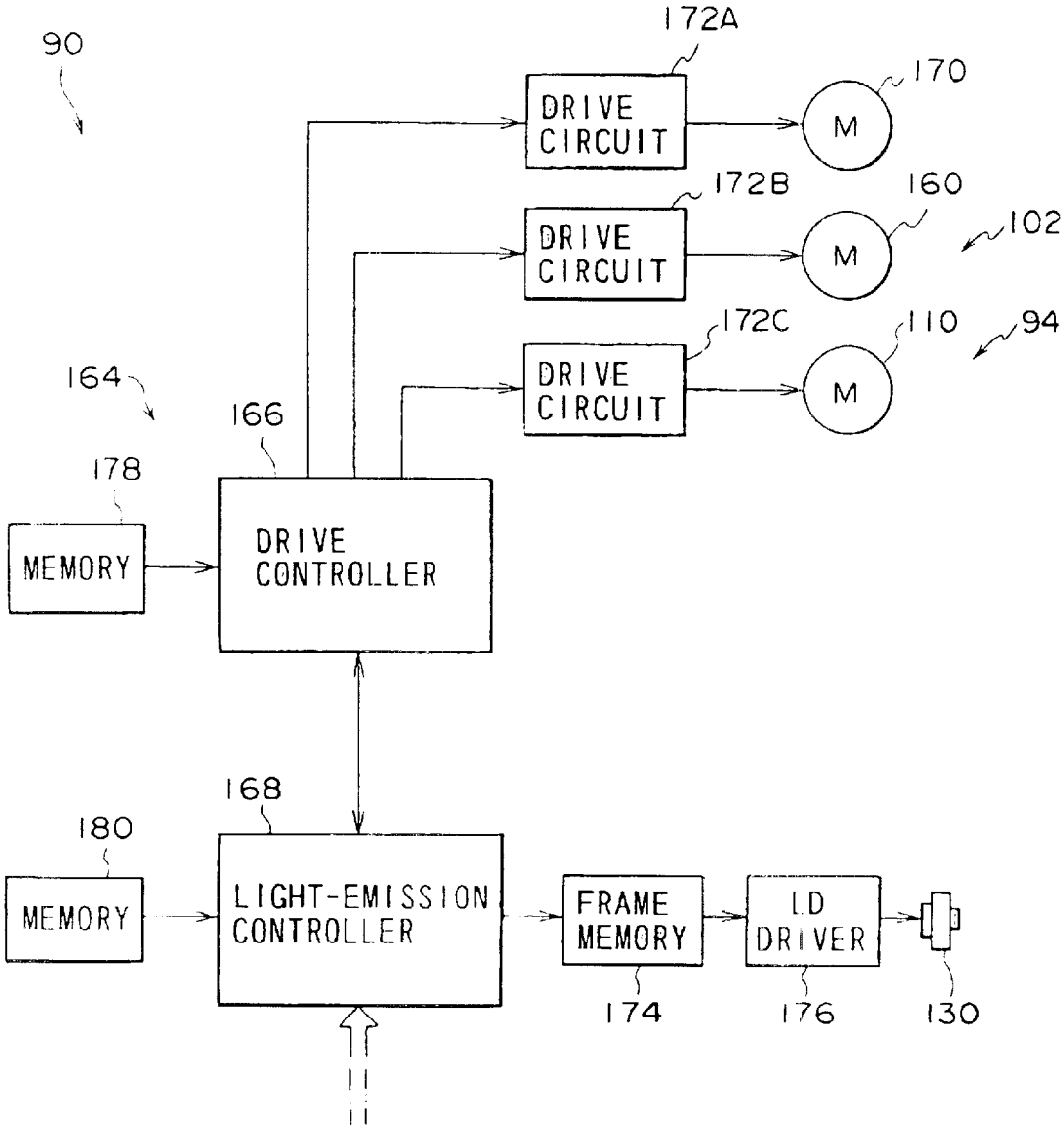
FIG. 5 is a block diagram showing a schematic structure of the scan-exposure apparatus.

As shown in FIG. 5, a drive controller 166 and a light-emission controller 168 are disposed at an exposure control section 164 of the scan-exposure apparatus 90. A main scanning motor 170, which rotatingly drives the rotating drum 54, the sub-scanning motor 160, and the stepping motor 110 of the distance adjusting mechanism 94 are connected to the drive controller 166 via drive circuits 172A, 172B and 172C, respectively. The drive controller 166 drives the sub-scanning motor 160 synchronously with the rotation of the rotating drum 54 due to drive of the main scanning motor 170. Accordingly, the exposure head 92 is moved in the sub-scanning direction synchronously with the movement in the main scanning direction of the printing plate 12 wound onto the rotating drum 54.

The laser diode (hereinafter, referred to as an "LD 130") provided in the light source assembly 124 of the light source unit 100 is connected to the light-emission controller 168 via a frame memory 174 and an LD driver 176. Further, data of an image to be formed on the printing plate 12 is inputted in the light-emission controller 168.

When the light-emission controller 168 causes the LD 130 to emit light on the basis of the inputted image data, the light-emission controller 168 extracts light-emission data for one main scanning line, and outputs the light-emission data to the frame memory 174. The frame memory 174 outputs the light-emission data to the LD driver 176 synchronously with the rotation of the rotating drum 54 and the movement of the exposure head 92, such that the LD 130 emits light. In this way, exposure for one main scanning line is carried out for the printing plate 12. This process is repeated so as to form an exposure image in accordance with the image data.

The exposure control section 164 is provided with a memory 178 which is connected to the drive controller 166, and a memory 180 which is connected to the light-emission controller 168. Distance correction data used for operating the distance adjusting mechanism 94 is recorded in the memory 178. Light-emission correction data used for setting the timing at which the LD 130 emits light on the basis of the light-emission data for one main scanning line is recorded in the memory 180.

Once the assembly of the exposure head 92, the rotating drum 54 and the like has been completed, distance between the exposure head 92 and the rotating drum 54, and the position (along a direction of arrow Y in FIG. 3) at which the printing plate 12 (on the rotating drum 54) is irradiated with the light beam emitted from the exposure head, are measured while the exposure head 92 is moved in the sub-scanning direction by the sub-scanning mechanism 102. Thereafter, on the basis of the measurement results, distance correction data for correcting the distance between the exposure head 92 and the rotating drum 54, and light-emission correction data for correcting the timing at which light is emitted from the LD 130, are generated. Then, the distance correction data is recorded in the memory 178 and the light-emission correction data is recorded in the memory 180.

The distance between the exposure head 92 and the rotating drum 54 (e.g., the distance between the exposure stage 106 and the peripheral surface of the rotating drum 54), and deviation in the position at which the printing plate 12 is irradiated with the light beam in the main scanning direction (i.e., the direction of arrow Y) with respect to a reference position, are measured every time the exposure head 92 moves one step. By step is meant a predetermined amount (e.g., 10 to 50 mm) of movement for exposure made by the exposure head 92 in the sub-scanning direction (i.e., the direction of arrow X), with respect to the reference position being, for example, the position at which exposure of the recording medium is initiated.

Figure 6A:
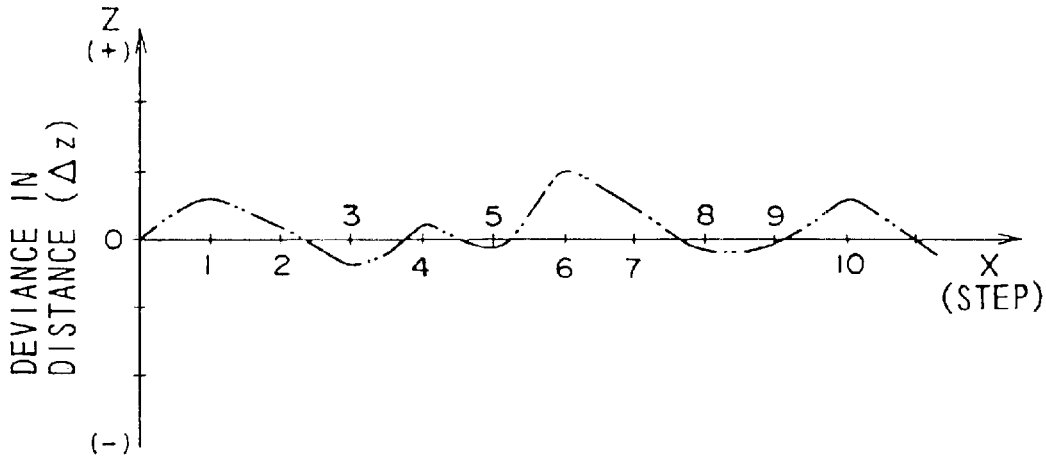
FIG. 6A is a diagram showing an example of results obtained by measuring deviance in distance between the exposure head and the rotating drum and a standard distance at every step.
Figure 6B:
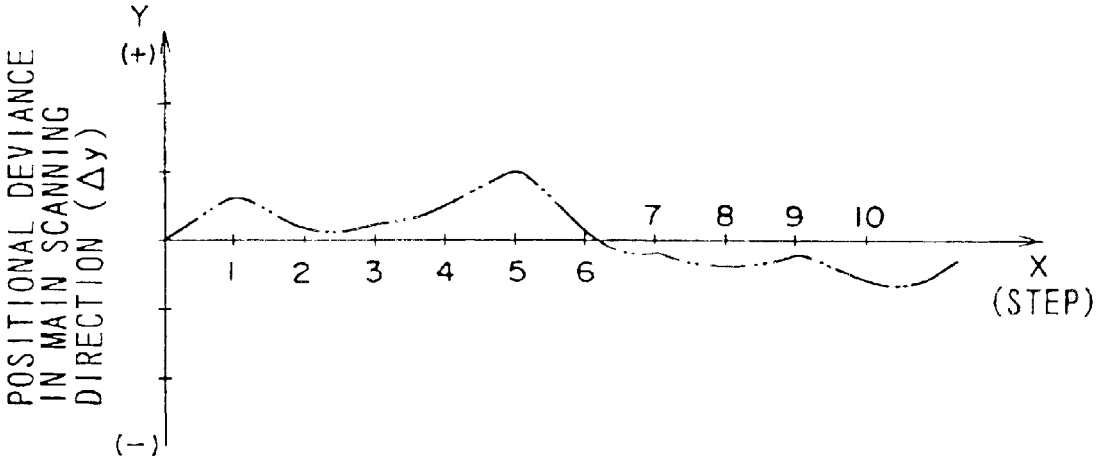
FIG. 6B is a diagram showing an example of results obtained by measuring positional deviance between an irradiation position irradiated by a light beam and a standard position in a main scanning direction at every step.

As shown in FIG. 6A, for example, an amount $\Delta z$ by which the distance between the exposure head 92 and the rotating drum 54 deviates from a standard distance (e.g., distance at which the light beam has a suitable spot diameter) is measured at each step (steps $x_N$, wherein N is 0 to n). As shown in FIG. 6B, an amount $\Delta y$ by which the position of the light beam in the main scanning direction deviates from a preset standard position is measured at each step.

The amount by which the exposure head 92 moves per step is preferably determined on the basis of the amount by which the feed screw 156 moves per one revolution. Further, this measurement is carried out at least in an exposure region for a maximum-sized printing plate 12 (e.g., about 1,200 mm).

The results of these measurements are respectively recorded in the memories 178 and 180 as distance correction data and light-emission correction data maps.

At the scan-exposure apparatus 90 structured in this manner, the sub-scanning motor 160 is driven synchronously with the rotation of the rotating drum 54 on which the printing plate 12 has been wound (drive of the main scanning motor 170). Thus, the printing plate 12 moves in the main scanning direction and the exposure head 92 moves in the sub-scanning direction. Further, at the scan-exposure apparatus 90, the LD 130 emits light in accordance with image data, synchronously with the rotation of the rotating drum 54 and the movement of the exposure head 92. As a result, the printing plate 12 is scan-exposed to form an image in accordance with the image data.

The drive controller 166 drives the stepping motor 110 on the basis of the distance correction data in the memory 178, synchronously with the movement in the sub-scanning direction of the exposure head 92 that is driven by the sub-scanning motor 160. Accordingly, the distance between the exposure head 92 and the rotating drum 54 is kept constant.

The light-emission controller 168 corrects, on the basis of the light-emission correction data recorded in the memory 180, the timing at which the LD 130 is made to emit light, and causes the LD 130 to emit light synchronously with the movement of the exposure head 92 in the sub-scanning direction. Accordingly, the light beam is irradiated at a predetermined position on the printing plate 12 in the main scanning direction.

Next, with reference to flow charts shown in FIGS. 7 and 8, correction of the distance between the exposure head 92 and the rotating drum 54, and correction of the timing at which the LD 130 emits light will be described. The following description assumes that the exposure head 92 scan-exposes the printing plate 12 within a range of steps $x_0$ to $x_n$ (steps $x_N$, wherein N is 0 to n).

Figure 7:
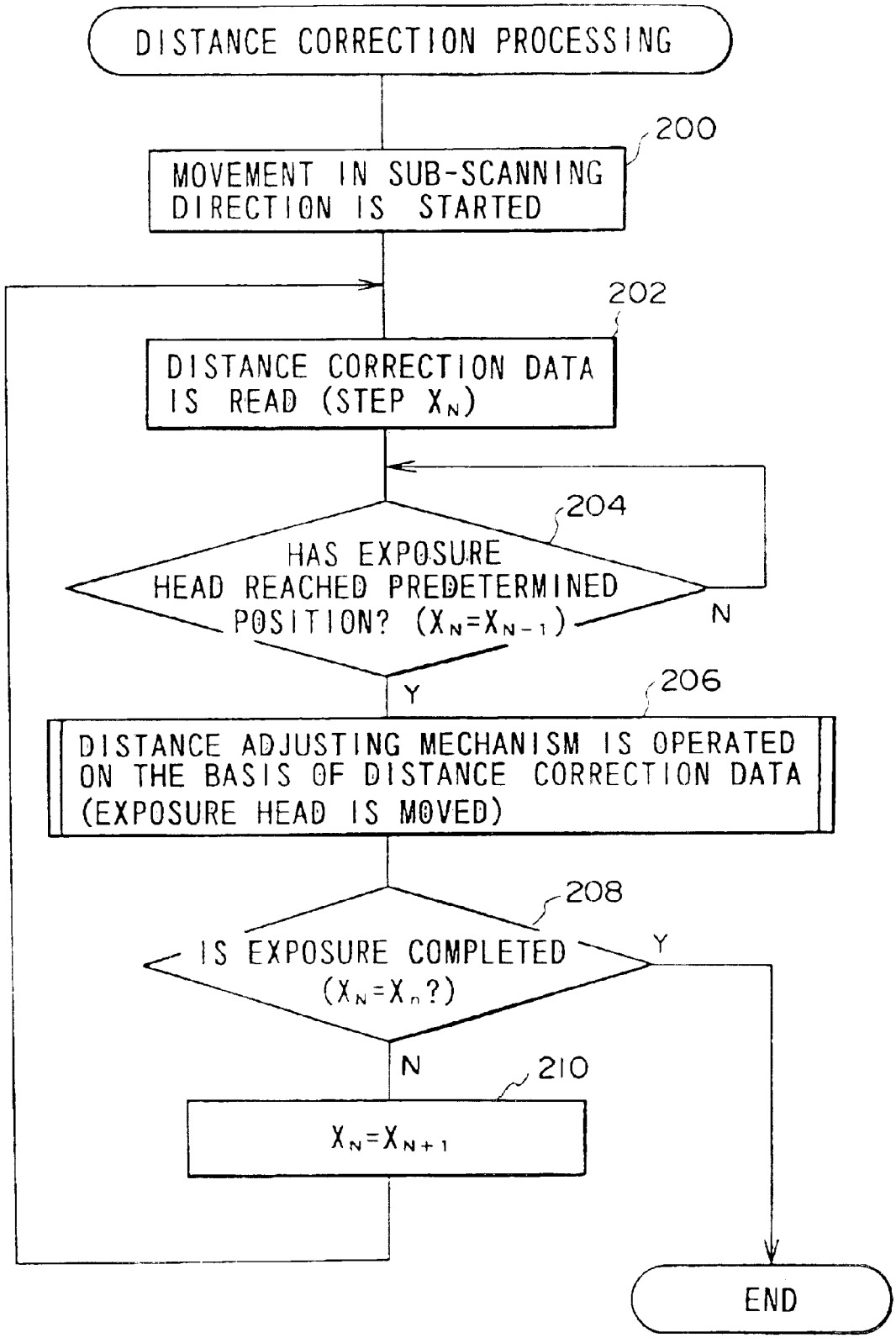
FIG. 7 is a flow chart schematically showing a process for correcting the distance between the exposure head and the rotating drum on the basis of distance correction data obtained from the measurement results.

FIG. 7 shows an outline of the distance correction processing. When the rotating drum 54 on which the printing plate 12 has been wound starts to rotate in the main scanning direction, distance correction processing is executed. In step 200, the sub-scanning motor 160 is driven to move the exposure head 92 in the sub-scanning direction.

In step 202, distance correction data for a single step immediately before exposure (step $x_N=x_1$) is read, and in step 204, it is determined whether or not the exposure head 92 has reached the distance at which movement for exposure for a single step is initiated on the basis of the distance correction data read in the step 202 (step $x_{N-1}=x_0$).

If the exposure head 92 has reached the distance at which movement for a single step is initiated and the answer in step 204 is affirmative, the process proceeds to step 206. In step 206, the stepping motor 110 is driven, and movement for exposure equivalent to a single step is carried out on the basis of the distance correction data read in step 202, and the steps 202, 204 and 206 are repeated.

In step 208, it is determined whether or not the exposure head 92 has reached the step at which exposure of the printing plate 12 is completed (step $x_N=x_n$). If the exposure head 92 has not reached the last step, the routine proceeds to step 210. In step 210, a step is added (N=N+1, i.e., $x_N=x_{N+1}$), and the routine returns to step 202. If the answer in step 208 is affirmative, the exposure head 92 is returned to the original position where the exposure head 92 had been prior to the commencement of scan-exposing, and distance correction processing is completed.

In this way, the exposure head 92 is moved toward and away from the rotating drum 54 on the basis of the distance correction data recorded in the memory 178. In other words, the exposure head 92 is moved so as to reduce the amount $\Delta z$ of deviation shown in FIG. 6A.

As a result, the distance between the exposure head 92 and the rotating drum 54 is substantially constant, the spot diameter of the light beam irradiated onto the printing plate 12 is suitably kept, and the light beam can be prevented from going out of focus while the printing plate 12 is being exposed.

Figure 8:
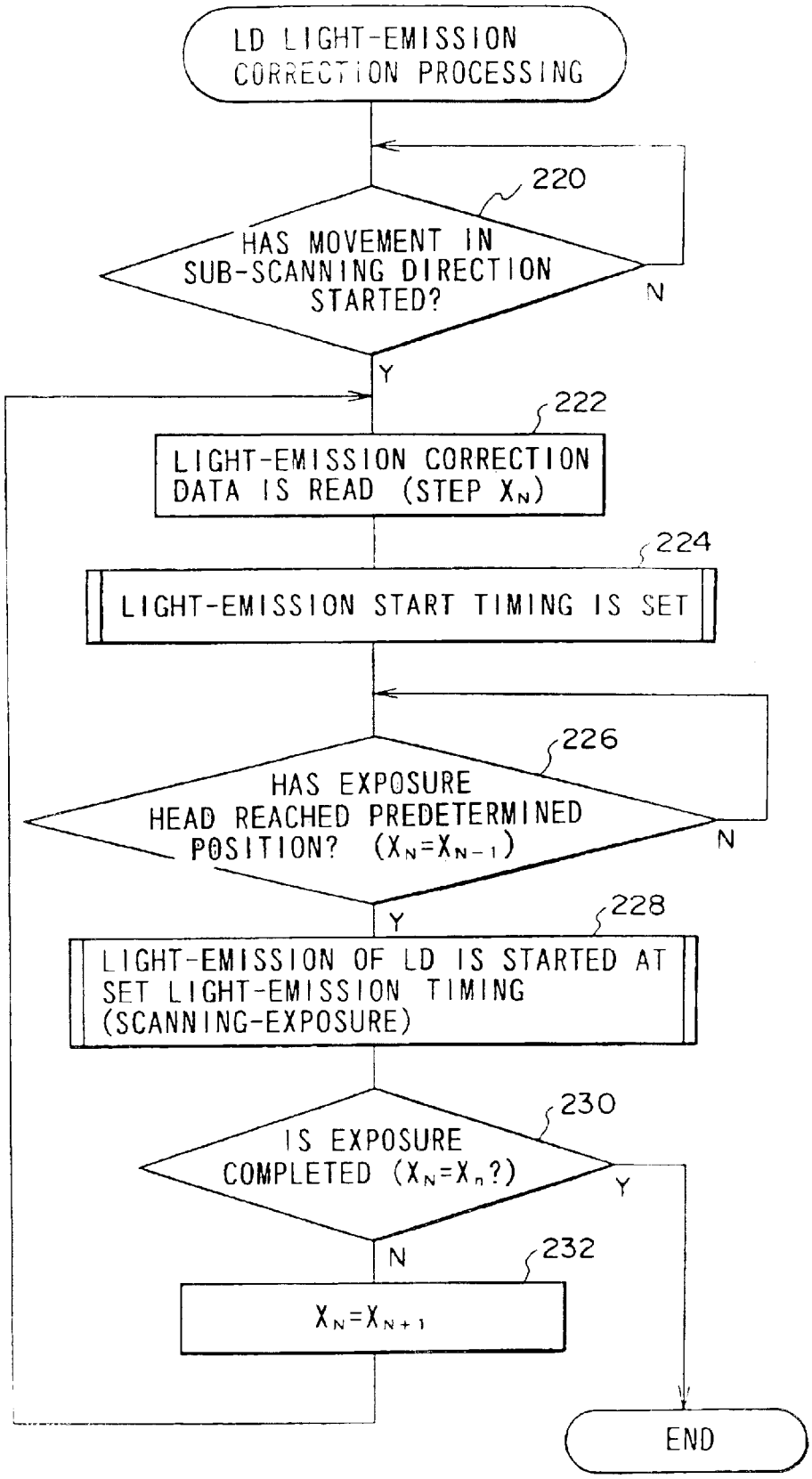
FIG. 8 is a flow chart schematically showing a process for correcting light-emission of an LD on the basis of light-emission correction data obtained from the measurement results.

FIG. 8 schematically shows the light-emission correction process for the LD 130. When the rotating drum 54 on which the printing plate 12 has been wound starts to rotate in the main scanning direction, the light-emission correction process is executed simultaneously with the distance correction process shown in FIG. 7. In step 220, the sub-scanning motor 160 is driven, and it is determined whether or not the exposure head 92 has started moving in the sub-scanning direction. If the exposure head 92 has started moving in the sub-scanning direction and the answer in step 220 is affirmative, the routine proceeds to step 222.

In step 222, light-emission correction data for a single step immediately before exposure (step $x_N=x_1$) is read, and in step 224, the light-emission start timing of the LD 130 is set for each main scanning line on the basis of the light-emission correction data read in step 222. At the scan-exposure apparatus 90, the position of the printing plate 12, which is wound onto the rotating drum 54 and rotated so as to be moved in the main scanning direction, is detected by an unillustrated start-of-scanning (SOS) sensor, and the LD 130 begins emitting light on the basis of the detection results to carry out scan-exposure for one main scanning line. The light-emission start timing of the LD 130 is set on the basis of the amount Δy recorded in the memory 180 and main scanning speed of the printing plate 12 (speed at which the printing plate 12 is moved in the main scanning direction). Namely, the light-emission timing of the LD 130 is changed in accordance with the amount Δy.

In step 226, it is determined whether or not the exposure head 92 has reached the position where movement for exposure for a single step is initiated (step $x_{N-1}=x_0$).

If the exposure head 92 has reached the position at which movement for a single step is initiated and the answer in step 226 is affirmative, the routine proceeds to step 228. In step 228, light-emission is carried out by the LD 130 at the light-emission timing that is set on the basis of the light-emission data recorded in the frame memory 174, and the steps 222, 224, 226 and 228 are repeated.

In step 230, it is determined whether or not the exposure head 92 has reached the step at which exposure of the printing plate 12 is completed (step $x_N=x_n$). If the exposure head 92 has not reached the last step, the routine proceeds to step 232. In step 232, a step is added (N=N+1, i.e., $x_N=x_{N+1}$), and then the routine returns to step 222.

By controlling the light-emission timing of the LD 130 on the basis of the light-emission correction data recorded in the memory 180 as described above, the light beam can be irradiated at a constant position in the main scanning direction to form pixels. That is, by controlling the timing at which light is emitted from the LD 130 on the basis of the amount Δy by which the position of the light beam in the main scanning direction deviates from a preset standard position as shown in FIG. 6B, it becomes possible to prevent deviations in the position at which the light beam is irradiated in the main scanning direction from occurring, whereby the light beam can be irradiated to a constant position with respect to the main scanning direction.

In this manner, the distance between the exposure head 92 and the rotating drum 54 can be controlled on the basis of the pre-generated distance correction data, and the timing at which the LD 130 emits light can be controlled on the basis of the pre-generated light-emission correction data. Thus, a light beam having a suitable spot diameter can be irradiated at a suitable position on the printing plate 12 to suitably scan-expose the printing plate 12.

Therefore, even if the machining accuracy of the respective parts that form the scan-exposure apparatus 90 is low, it is still possible to form an image of high quality on the printing plate 12 even if assembly and adjustment of the positions of respective parts at the time of assembly is simplified. Thus, it becomes possible to reduce the cost of parts for the scan-exposure apparatus 90 and to reduce the cost of the scan-exposure apparatus 90 by reducing the number of steps required for assembling the parts.

The structure of the present invention is not limited to the above-described embodiment. For example, in this embodiment, the sub-scanning mechanism 102 and the distance adjusting mechanism 94 comprise the feed screws and the feed nuts. However, the sub-scanning mechanism and the distance adjusting mechanism are not limited to this structure, and may respectively comprise an arbitrary structure for moving the exposure head 92 in the sub-scanning direction and an arbitrary structure for moving the exposure head 92 forward and away from the rotating drum 54.

Further, in this embodiment, the scan-exposure apparatus 90 for scan-exposing the printing plate 12, and the image forming apparatus 10 which is provided with the scan-exposure apparatus 90 have been exemplarily described. However, the present invention may be applied to a scan-exposure apparatus having an arbitrary structure and an image forming apparatus, wherein a recording medium other than a photosensitive planographic printing plate exemplified by the printing plate 12, such as a photosensitive material like photographic film or photographic printing paper, a photosensitive drum, or the like, may be used as the recording medium.

Furthermore, in this embodiment, the printing plate 12 is scan-exposed while being moved in the main scanning direction and the exposure head 92 is being moved in the sub-scanning direction. However, the present invention may also comprise a structure in which a recording medium, such as the printing plate 12, is scan-exposed while the recording medium is being moved along the sub-scanning direction and the exposure head 92 is being moved along the main scanning direction.

As described above, according to the present invention, distance between a light source and a recording medium can be controlled on the basis of pre-measured distance correction data and timing at which light is emitted from the light source can be controlled on the basis of pre-measured light-emission correction data. Accordingly, it becomes possible to prevent the light beam that is irradiated onto the recording medium from going out of focus and to reduce the amount by which the position irradiated with the light beam deviates from a preset reference position. Therefore, regardless of the accuracy of machining or assembly of the respective parts that form the scan-exposure apparatus, it is still possible to form an image of high quality and to reduce the cost of the apparatus.

What is claimed is:

1. A method for controlling exposure, wherein a recording medium is irradiated with a light beam emitted from a light source which is moved along one of main scanning and sub-scanning directions by a light source scanning apparatus, the recording medium being moved along the other of the main scanning and the sub-scanning directions, to scan-expose the recording medium, the method comprising:

obtaining distance correction data which is generated by measuring distance between the recording medium and the light source while the light source is being moved by the light source scanning apparatus; and performing distance correction processing, in which during scan-exposing of the recording medium, the light source is moved toward and away from the recording medium synchronously with the movement of the light source by the light source scanning apparatus based on the distance correction data.

2. The method for controlling exposure of claim 1, the method further comprising:

obtaining light-emission correction data which is generated by measuring a position irradiated with the light beam emitted from the light source onto the recording medium while the light source is being moved by the light source scanning apparatus; and performing light-emission correction processing, wherein, during scan-exposing of the recording medium, light-emission of the light source is controlled synchronously with the movement of the light source by the light source scanning apparatus based on the light-emission correction data.

3. The method for controlling exposure of claim 2, wherein the light-emission correction processing comprises the steps of:

a) initiating movement of the light source by the light source scanning apparatus;

b) reading the light-emission correction data for one step immediately before exposure, the one step being a predetermined amount by which the light source is moved for exposure by the light source scanning apparatus;

c) setting light-emission initiating timing on the basis of the light-emission correction data which has been read;

d) identifying that the light source has reached a position at which the movement for exposure for the one step is initiated;

e) carrying out the light-emission of the light source at the light-emission initiating timing which has been set, and repeating the steps b), c), d) and e); and f) returning the light source to the position at which the scan-exposure initiated, when the light source has reached a position at which the exposure for the recording medium is completed.

4. The method for controlling exposure of claim 3, wherein the distance correction processing and the light-emission connection processing are performed concurrently.

5. The method for controlling exposure of claim 1, wherein the distance correction processing comprises the steps of:

a) initiating movement of the light source by the light source scanning apparatus;

b) reading the distance correction data for one step immediately before exposure, the one step being a predetermined amount by which the light source is moved for exposure by the light source scanning apparatus;

c) identifying that the light source has reached a distance at which the movement for exposure for the one step is initiated;

d) carrying out the movement for exposure for the one step of the light source by the light source scanning apparatus, and repeating the steps b), c) and d); and e) returning the light source to the position where the scan-exposure initiated, when the light source has reached a position at which the exposure of the recording medium is completed.

6. The method for controlling exposure of claim 5, wherein the distance correction processing is repeated a predetermined number of times.

7. The method for controlling exposure of claim 1, wherein the distance correction processing comprises the steps of:

a) initiating movement of the light source by the light source scanning apparatus;

b) reading the distance correction data for one step before exposure, the one step being a predetermined amount by which the light source is moved for exposure by the light source scanning apparatus; and c) carrying out the movement for exposure for the one step of the light source by the light source scanning apparatus, and repeating the steps b) and c).

8. A method for controlling exposure, wherein a recording medium is irradiated with a light beam emitted from a light source which is moved along one of main scanning and sub-scanning directions by a light source scanning apparatus, the recording medium being moved along the other of the main scanning and the sub-scanning directions, to scan-expose the recording medium, the method comprising:

obtaining light-emission correction data which is generated by measuring a position irradiated with the light beam emitted from the light source onto the recording medium while the light source is being moved by the light source scanning apparatus; and performing light-emission correction processing, wherein, during scan-exposing of the recording medium, light-emission of the light source is controlled synchronously with the movement of the light source by the light source scanning apparatus based on the light-emission correction data.

9. The method for controlling exposure of claim 8, the method further comprising:

obtaining distance correction data which is generated by measuring distance between the recording medium and the light source while the light source is being moved by the light source scanning apparatus; and performing distance correction processing, wherein, during scan-exposing of the recording medium, the light source is moved toward and away from the recording medium synchronously with the movement of the light source by the light source scanning apparatus based on the distance correction data.

10. The method for controlling exposure of claim 9, wherein the distance correction processing comprises the steps of:

a) initiating movement of the light source by the light source scanning apparatus;

b) reading the distance correction data for one step immediately before exposure, the one step being a predetermined amount by which the light source is moved for exposure by the light source scanning apparatus;

c) identifying that the light source has reached a distance at which the movement for exposure for the one step is initiated;

d) carrying out the movement for exposure for the one step of the light source by the light source scanning apparatus, and repeating the steps b), c) and d); and e) returning the light source to the position where the scan-exposure initiated, when the light source has reached a position at which the exposure of the recording medium is completed.

11. The method for controlling exposure of claim 10, wherein the distance correction processing and the light-emission correction processing are performed concurrently.

12. The method for controlling exposure of claim 8, wherein the light-emission correction processing comprises the steps of:

a) initiating movement of the light source by the light source scanning apparatus;

b) reading the light-emission correction data for one step immediately before exposure, the one step being a predetermined amount by which the light source is moved for exposure by the light source scanning apparatus;

c) setting light-emission initiating timing on the basis of the light-emission correction data which has been read;

d) identifying that the light source has reached a position at which the movement for exposure for the one step is initiated;

e) carrying out the light-emission of the light source at the light-emission initiating timing which has been set, and repeating the steps b), c), d) and e); and f) returning the light source to the position at which the scan-exposure initiated, when the light source has reached a position at which the exposure for the recording medium is completed.

13. The method for controlling exposure of claim 12, wherein the light-emission correction processing is repeated a predetermined number of times.

14. The method for controlling exposure of claim 8, wherein the light-emission correction processing comprises the steps of:

a) initiating movement of the light source by the light source scanning apparatus;

b) reading the light-emission correction data for one step before exposure, the one step being a predetermined amount by which the light source is moved for exposure by the light source scanning apparatus;

c) setting light-emission initiating timing on the basis of the light-emission correction data which has been read; and d) carrying out the light-emission of the light source at the light-emission initiating timing which has been set, and repeating the steps b), c) and d).

15. A scan-exposure apparatus, wherein a recording medium is irradiated with a light beam emitted from a light source which is moved along one of main scanning and sub-scanning directions, the recording medium being moved along the other of the main scanning and the sub-scanning directions, to scan-expose the recording medium, the apparatus comprising:

a) a light source scanning apparatus, which moves the light source in one of the main scanning and the sub-scanning directions synchronously with the movement of the recording medium moving in the other of the main scanning and the sub-scanning directions;

b) a light source moving apparatus, which moves the light source toward and away from the recording medium;

c) a distance correction data memory, which stores distance correction data, which is generated by measuring distance between the recording medium and the light source while the light source is being moved by the light source scanning apparatus; and d) a movement controlling apparatus, which, during the scan-exposing of the recording medium, operates the light source moving apparatus on the basis of the distance correction data which has been stored in the distance correction data memory, synchronously with the movement of the light source by the light source scanning apparatus.

16. The scan-exposure apparatus of claim 15, the apparatus further comprising:

a) a light-emission correction data memory, which stores light-emission correction data, which is generated by measuring a position irradiated by the light beam emitted from the light source onto the recording medium while the light source is being moved by the light source scanning apparatus; and b) a light-emission controlling apparatus, which, during the scan-exposing of the recording medium, controls light-emission of the light source on the basis of the light-emission correction data which has been stored in the light-emission correction data memory, synchronously with the movement of the light source by the light source scanning apparatus.

17. A scan-exposure apparatus, wherein a recording medium is irradiated with a light beam emitted from a light source which is moved along one of main scanning and sub-scanning directions, the recording medium being moved along the other of the main scanning and the sub-scanning directions, to scan-expose the recording medium, the apparatus comprising:

a) a light source scanning apparatus, which moves the light source in one of the main scanning and the sub-scanning directions synchronously with the movement of the recording medium in the other of the main scanning and the sub-scanning directions;

b) a light-emission correction data memory, which stores light-emission correction data, which is generated by measuring a position irradiated by the light beam emitted from the light source onto the recording medium while the light source is being moved by the light source scanning apparatus; and c) a light-emission controlling apparatus, which, during the scan-exposing of the recording medium, controls light-emission of the light source on the basis of the light-emission correction data which has been stored in the light-emission correction data memory, synchronously with the movement of the light source by the light source scanning apparatus.

18. The scan-exposure apparatus of claim 17, the apparatus further comprising:

a) a light source moving apparatus, which moves the light source toward and away from the recording medium;

b) a distance correction data memory, which stores distance correction data, which is generated by measuring distance between the recording medium and the light source while the light source is being moved by the light source scanning apparatus; and c) a movement controlling apparatus, which, during the scan-exposing of the recording medium, operates the light source moving apparatus on the basis of the distance correction data which has been stored in the distance correction data memory, synchronously with the movement of the light source by the light source scanning apparatus.

19. A scan-exposure apparatus, wherein a recording medium is irradiated with a light beam emitted from a light source which is moved along one of main scanning and sub-scanning directions, the recording medium being moved along the other of the main scanning and the sub-scanning directions, to scan-expose the recording medium, the apparatus comprising:

a) a light source scanning apparatus, which moves the light source in one of the main scanning and the sub-scanning directions synchronously with the movement of the recording medium in the other of the main scanning and the sub-scanning directions;

b) a light source moving apparatus, which moves the light source toward and away from the recording medium;

c) a distance correction data memory, which stores distance correction data, which is generated by measuring distance between the recording medium and the light source while the light source is being moved by the light source scanning apparatus;

d) a light-emission correction data memory, which stores light-emission correction data, which is generated by measuring a position irradiated by the light beam emitted from the light source onto the recording medium while the light source is being moved by the light source scanning apparatus;

e) a movement controlling apparatus, which, during the scan-exposing of the recording medium, operates the light source moving apparatus on the basis of the distance correction data synchronously with the movement of the light source by the light source scanning apparatus; and f) a light-emission controlling apparatus, which, during the scan-exposing of the recording medium, controls light-emission of the light source on the basis of the light-emission correction data synchronously with the movement of the light source by the light source scanning apparatus.

* * * * *